United States Patent [19]

Trzaskos

[11] 4,382,201

[45] May 3, 1983

[54] ULTRASONIC TRANSDUCER AND PROCESS TO OBTAIN HIGH ACOUSTIC ATTENUATION IN THE BACKING

[75] Inventor: Casmir R. Trzaskos, Amsterdam, N.Y.

[73] Assignee: General Electric Company, Schenectady, N.Y.

[21] Appl. No.: 258,226

[22] Filed: Apr. 27, 1981

[51] Int. Cl.[3] ..... H04R 17/00

[52] U.S. Cl. ..... 310/327; 310/336; 264/102; 264/332

[58] Field of Search ..... 310/326, 327, 336, 345, 310/800; 333/81 R, 194, 195; 264/102, 332

[56] References Cited

U.S. PATENT DOCUMENTS

| | | | |
|---|---|---|---|
| 2,881,336 | 4/1959 | Elion | 310/327 |
| 3,376,438 | 4/1968 | Colbert | 310/327 |
| 3,631,271 | 12/1971 | Shimada | 310/345 X |
| 3,794,866 | 2/1974 | McElroy et al. | 310/327 |
| 4,205,686 | 6/1980 | Harris et al. | 128/660 |
| 4,240,003 | 12/1980 | Larson | 310/336 X |

OTHER PUBLICATIONS

Lees et al., "Acoustic Properties of Tungsten-Vinyl Composites", IEEE Transactions on Sonics and Ultrasonics, vol. SU-20, No. 1, Jan. 1973, pp. 1, 2.

*Primary Examiner*—William M. Shoop
*Assistant Examiner*—Peter S. Wong
*Attorney, Agent, or Firm*—Donald R. Campbell; James C. Davis, Jr.; Marvin Snyder

[57] ABSTRACT

A high frequency ultrasonic transducer is improved by fabricating the tungsten-polyvinyl chloride composite, which backs the elements, in a specific manner. Small particle size tungsten powder and PVC powder are placed into a high pressure die. Standard processing of the powder mixture includes degasing followed by heating and compressing. To maximize the acoustic attenuation, the pressure applied to the mixture is maintained until it has cooled down. The composite is in a state of elastic compression and spontaneously expands when removed from the die, giving rise to the high levels of acoustic attenuation.

5 Claims, 3 Drawing Figures

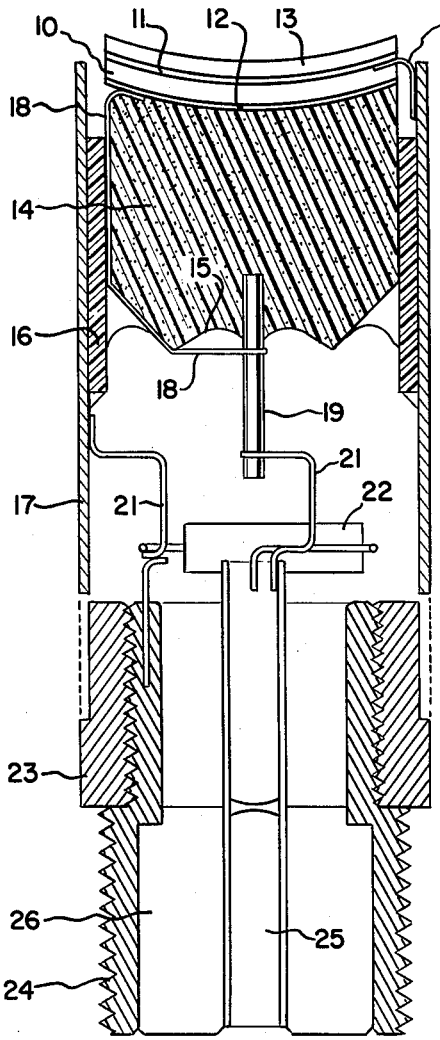
Fig. 1
Fig. 3
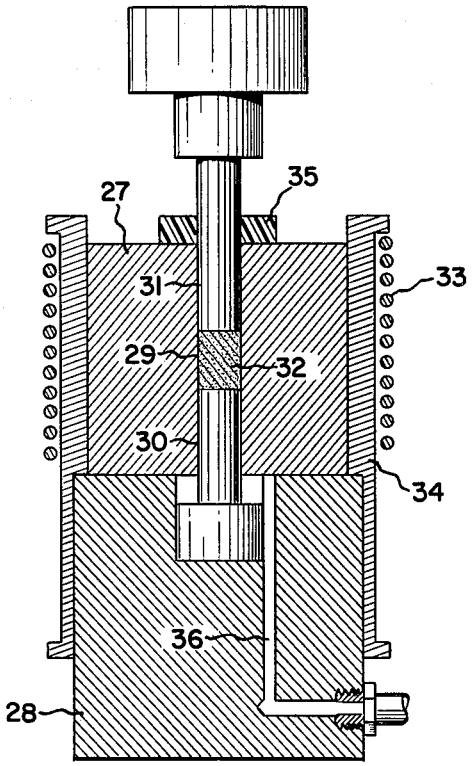
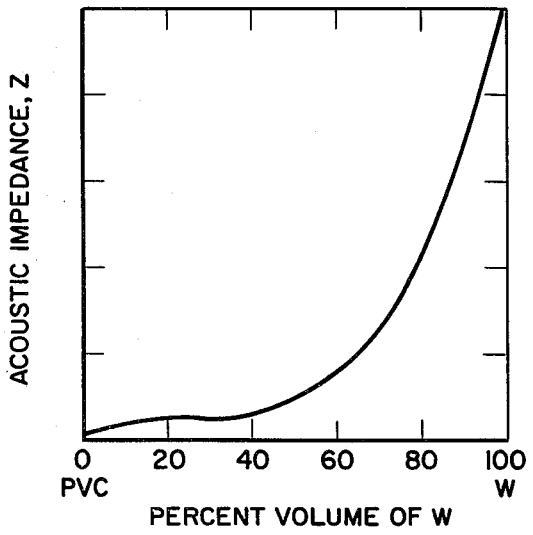
Fig. 2

ULTRASONIC TRANSDUCER AND PROCESS TO OBTAIN HIGH ACOUSTIC ATTENUATION IN THE BACKING

BACKGROUND OF THE INVENTION

This invention relates to a process for obtaining high levels of acoustic attenuation in a tungsten-polyvinyl chloride composite and to an improved high frequency ultrasonic transducer.

Tungsten-PVC composites are commonly used as backings in transducer assemblies. Ideally, all of the acoustic energy entering the backing should be dissipated there. Often this is not the case and the acoustic energy reflected from the interior of the backing returns to the element giving rise to spurious signals. The effective sensitivity of the transducer is limited by these unwanted signals.

Tungsten-PVC composites have been prepared containing relatively large tungsten particles (50 micron diameter) which act as scattering centers, thereby increasing the attenuation in the composite. The acoustic waves are reflected by the large particles and have a longer path length. This system, with 30–50 percent large particles and the balance of the tunsten as small particles, is good at low ultrasonic frequencies but is not very effective at frequencies greater than about 4.5 MHz. At the higher frequencies the large particles reflect increasing amounts of acoustic energy back into the element, and as a result the noise level increases.

SUMMARY OF THE INVENTION

A process for obtaining high acoustic attenuation in a tungsten-polyvinyl chloride composite, to be the backing for piezoelectric elements in 4.5 MHz and higher ultrasonic transducers, comprises placing a mixture of small particle size tungsten powder (less than 10 micron diameter) and PVC powder into a high pressure die. The volume ratio of the mixture is chosen to yield a specific acoustic impedance. The die chamber is evacuated to degas the powders, and the mixture is heated to 100°–120° C. and pressure of 40,000 to 48,000 pounds/in$^2$ is applied to compress the powders into a dense, compact composite. To obtain maximum attenuation, the high pressure applied to the powder mixture is maintained until it has cooled down. The composite is now in a state of elastic compression and spontaneously expands when removed from the die. This slight expansion gives rise to the high levels of acoustic attenuation.

An improved high frequency transducer with a backing fabricated by this process is characterized by a significant reduction of noise generated by the backing. A preferred process is that the powder mixture has a volume ratio of 55 parts 4 micron tungsten powder to 45 parts polyvinyl chloride. The mixture is placed in a die, evacuated and heated to 115°–120° C. It is compressed gradually to a pressure of about 45,000 pounds/in$^2$. The pressure is maintained until the die has cooled to less than 50° C.

BRIEF DESCRIPTION OF THE DRAWING

FIG. 1 is a partly exploded vertical cross section of a single-element focused beam ultrasonic transducer;

FIG. 2 is a curve of acoustic impedance versus different compositions of a tungsten-PVC composite; and FIG. 3 is a vertical cross section through a high pressure die in which the powder mixture is heated and compressed.

DESCRIPTION OF THE PREFERRED EMBODIMENTS

The 5 MHz single-element focused transducer in FIG. 1 is designed for nondestructive testing. A curved piezoelectric, modified sodium niobate transducer element 10 has metallic electrodes 11 and 12 on both surfaces, and the thin cover layer 13 is epoxy. When excited electricaly, sound waves are emitted from the back as well as the front of transducer element 10. A cylindrical backing 14 is a tungsten-polyvinyl chloride composite fabricated according to this invention, and absorbs sound coming off the back side of the element. The backing must have two properties to meet this objective, and these are that it have the proper acoustic impedance and that it dissipates the acoustic energy, generally by conversion to heat. If the latter is not achieved any energy that passes all the way through is reflected by the back surface of backing 14, which is shaped as shown at 15 to break up the acoustic waves the deflect them away from the element.

Backing 14 is inside of a plastic sleeve 16 which is surrounded by a metal case 17. A foil lead 18 contacts electrode 12 and passes along the side and end of backing 14 and connects to a nickel post 19 supported in the backing. A ground lead 20 is connected between electrode 11 and case 17. Several flexible leads are designated at 21, a shunt resistor at 22, a metal base and socket at 23, and an RF connector outer conductor, center conductor, and insulation at 24-26.

The acoustic attenuation of the tungsten-PVC composite is enhanced and maximized by using only small particle size tungsten powder (10 micron or less) and processing the part in a specific manner. Standard processing of the tungsten-PVC mixture includes evacuation of the die chamber to degas the powders followed by heating and compressing to obtain a dense, compact body. The present process uses a temperature of 100°–120° C. and pressures which are gradually increased by steps to 40,000–48,000 pounds/in$^2$. To obtain maximum attenuation, the high pressure applied to the powder mixture is maintained until it has cooled down to below 50° C. or near room temperature. The composite is now in a state of elastic compression and spontaneously expands when removed from the die. This slight expansion gives rise to the high levels of acoustic attenuation.

Referring to FIG. 2, it is known that the acoustic impedance of the tungsten-PVC composite depends on the percentages of the constituents. The acoustic impedance for 100 percent tungsten is very high. It is the PVC, however, that does the acoustic absorbing and it is desirable to have as much PVC as possible. Another consideration is that for a fixed ratio of tungsten and PVC, the impedance varies with the applied pressure and there is a particular pressure at which the impedance is at maximum. High pressure leads to greater attenuation and the pressure is as high as possible while still getting the wanted impedance. A mixture is found that gives the chosen acoustic impedance at a particular pressure.

Modified sodium niobate has an acoustic impedance of approximately $25\times10^6$g/cm$^2$-sec, and the acoustic impedance of the backing composite is chosen to be about 85 percent of this value. The powder mixture preferably has a volume ratio of 55 parts 4 micron tungsten powder to 45 parts polyvinyl chloride. This backing has an acoustic impedance of approximately 21 in the same units.

The high pressure die is illustrated in FIG. 3. A cylindrical housing 27 is supported on a base 28 and has a central bore 29. A fixed tungsten carbide piston 30 and a movable tungsten carbide piston 31 extend into the central bore from below and above, and between them is the die chamber 32 into which the powders are placed. A resistance heating coil 33 is on the outside of the casing 34 and surrounds the housing 27. Element 35 is a seal for the movable piston 31, and passage 36 in base support 28 connects to an exhaust system.

The tungsten and PVC powder mixture is first thoroughly degased; all of the air in die chamber 32 is evacuated by an exhaust vacuum applied through passage 36. The powders are heated to a temperature of 115°–120° C. for a limited time period; it takes about one and one-half hours to reach the highest processing temmperature and it is held at the highest temperature for one hour or so. The pressure is gradually increased by steps, starting at one-half the final pressure, to a high pressure of approximately 45,000 pounds/in$^2$. The PVC becomes a fluid at 80° C. or so at these high pressures. The powder mixture is compressed into a dense, compact composite. The heating is stopped, but the high pressure is maintained until the die has cooled to less than 50° C.; with forced cooling by a fan it takes one hour to cool below this temperature. The composite can no longer undergo plastic deformation, and it is in a state of elastic compression. The cooled composite is removed from the die and spontaneously expands giving rise to the high levels of acoustic attenuation. A slug removed from a die with a bore diameter of three-quarters of an inch was 3–4 mils larger than the bore diameter.

A 4.5 MHz or higher ultrasonic transducer which has a backing in the form of a tungsten-polyvinyl chloride composite produced by this process, has a high level of acoustic attenuation in the backing. Almost all of the acoustic energy emitted from the back of the transducer element is absorbed, and there is a negligible amount of energy reflected back to the element. The resultant noise coming from the backing is less than generated background noise. As compared to prior processes, there is a factor of two in the improvement in reduction of noise generated by the backing.

Such a tungsten-PVC composite has proved to be useful as a backing for piezoelectric elements of lead zirconate titanate, lead metaniobate, and sodium niobate. Variations in the fabrication process are expected when backings are made for these other piezoelectric materials and if there is a large change in frequency. The PZT material, for instance, has a higher acoustic impedance than the modified sodium niobate and the backing impedance would be 25–26 in the same units, calling for a different ratio of tungsten and PVC powders. When the transducer operates at a much higher frequency than 5 MHz, the amount of PVC is increased. The particle size of the tungsten powder is relatively small, 10 microns or less. The process temperature may be as low as 100° C. and does not exceed 120° C. It was found that at a temperature of 140° C., the backing composite had flaws which acted as reflectors. Tungsten-polyvinyl chloride composites produced by this process are suitable as backings in single element transducers and in linear and annular transducer arrays.

While the invention has been particularly shown and described with reference to preferred embodiments thereof, it will be understood by those skilled in the art that the foregoing and other changes in form and details may be made therein without departing from the spirit and scope of the invention.

The invention claimed is:

1. A process for enhancing the acoustic attenuation of a tungsten-polyvinyl chloride ultrasonic transducer backing material comprising:

placing a mixture of tungsten powder and polyvinyl chloride powder into the chamber of a high pressure die, said tungsten powder having a particle size less than 10 microns and the volume ratio of tungsten to polyvinyl chloride being selected to yield a specific acoustic impedance;

evacuating the die chamber to degas said powders;

heating said powder mixture for a limited time and applying a pressure that is increased to a high pressure sufficient to compress said powders into a dense, compact composite;

continuing to apply said high pressure until said composite cools down to below 50° C. and is in a state of elastic compression; and removing said cooled composite from the die so that said composite spontaneously expands and acquires high levels of acoustic attenuation.

2. The process of claim 1 wherein said powder mixture is heated to 100°–120° C. and said high pressure is 40,000 to 48,000 pounds/in$^2$.

3. The process of claim 1 wherein said powder mixture has a volume ratio of about 55 parts 4 micron tungsten to 45 parts polyvinyl chloride.

4. The process of claim 3 wherein said powder mixture is heated to 115–120° C. and said high pressure is about 45,000 pounds/in$^2$.

5. An improved 4.5 megahertz or higher ultrasonic transducer comprising:

at least one piezoelectric transducer element having a front and a back surface and metallic electrodes on both surfaces;

a cover layer on the front surface of said element; and a tungsten-polyvinyl chloride composite backing on the back surface of said element which absorbs almost all the acoustic energy emitted from said back surface and is fabricated by the process of claim 1.

* * * * *